US010152935B2

(12) United States Patent
Tanaka et al.

(10) Patent No.: US 10,152,935 B2
(45) Date of Patent: Dec. 11, 2018

(54) COLOR CORRECTION APPARATUS, DISPLAY APPARATUS, AND COLOR CORRECTION METHOD

(71) Applicant: Mitsubishi Electric Corporation, Tokyo (JP)

(72) Inventors: Shogo Tanaka, Tokyo (JP); Kazuhiro Ishiguchi, Tokyo (JP); Hidetsugu Suginohara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/440,638

(22) Filed: Feb. 23, 2017

(65) Prior Publication Data

US 2017/0249888 A1 Aug. 31, 2017

(30) Foreign Application Priority Data

Feb. 29, 2016 (JP) ..... 2016-036625
Jul. 27, 2016 (JP) ..... 2016-146971

(51) Int. Cl.
*G09G 1/28* (2006.01)
*G09G 3/36* (2006.01)

(52) U.S. Cl.
CPC ... *G09G 3/3648* (2013.01); *G09G 2320/0666* (2013.01); *G09G 2360/16* (2013.01)

(58) Field of Classification Search
None
See application file for complete search history.

(56) References Cited

U.S. PATENT DOCUMENTS

| | | | |
|---|---|---|---|
| 5,987,168 | A | 11/1999 | Decker et al. |
| 6,137,596 | A | 10/2000 | Decker et al. |
| 6,330,075 | B1 | 12/2001 | Ishikawa |
| 7,333,136 | B2 | 2/2008 | Takemoto |
| 7,590,299 | B2 | 9/2009 | Brown Elliott et al. |
| 7,893,944 | B2 | 2/2011 | Higgins et al. |
| 8,159,498 | B2 | 4/2012 | Higgins et al. |
| 8,212,836 | B2 | 7/2012 | Matsumoto et al. |
| 8,223,166 | B2 | 7/2012 | Brown Elliott |
| 8,229,212 | B2 | 7/2012 | Siddiqui et al. |
| 8,264,497 | B2 | 9/2012 | Higgins et al. |
| 8,295,594 | B2 | 10/2012 | Brown Elliott et al. |

(Continued)

FOREIGN PATENT DOCUMENTS

| | | |
|---|---|---|
| JP | H09-102886 A | 4/1997 |
| JP | H10-297026 | 11/1998 |

(Continued)

*Primary Examiner* — Yingchun He
(74) *Attorney, Agent, or Firm* — Studebaker & Brackett PC

(57) ABSTRACT

R, G, and B are corrected according to a one-dimensional lookup table R_LUT, a one-dimensional lookup table G_LUT, and a one-dimensional lookup table B_LUT, respectively. W is corrected according to one-dimensional lookup tables W_LUT (R), W_LUT (G), and W_LUT (B). The extent of a contribution to post-correction tone values Rout, Gout, and Bout of each of tone values obtained from the former correction and tone values obtained from the latter correction is modified according to a color expressed by a group of pre-correction tone values Rin, Gin, and Bin. As the above-mentioned color is closer to white, the contribution to the tone values obtained from the latter correction increases.

9 Claims, 5 Drawing Sheets

(56) References Cited

U.S. PATENT DOCUMENTS

| | | | | |
|---|---|---|---|---|
| 8,633,952 | B2 | 1/2014 | Higgins et al. | |
| 8,649,056 | B2 | 2/2014 | Kobayashi | |
| 9,025,223 | B2 | 5/2015 | Murakami | |
| 9,430,986 | B2 | 8/2016 | Ito et al. | |
| 2004/0170316 | A1* | 9/2004 | Saquib ..... | H04N 1/4072<br>382/162 |

FOREIGN PATENT DOCUMENTS

| | | | |
|---|---|---|---|
| JP | H10-307911 | A | 11/1998 |
| JP | 2002-016939 | A | 1/2002 |
| JP | 2005-072850 | A | 3/2005 |
| JP | 2006-128815 | A | 5/2006 |
| JP | 2006-303785 | A | 11/2006 |
| JP | 2008-085731 | A | 4/2008 |
| JP | 2009-004862 | A | 1/2009 |
| JP | 2009-093182 | A | 4/2009 |
| JP | 2009-282977 | A | 12/2009 |
| JP | 2010-271367 | A | 12/2010 |
| JP | 2012-170017 | A | 9/2012 |
| JP | 2012-170018 | A | 9/2012 |
| JP | 2012-230405 | A | 11/2012 |
| JP | 2014-041377 | A | 3/2014 |
| JP | 2014-120796 | A | 6/2014 |
| WO | 2005/124663 | A2 | 12/2005 |
| WO | 2009/101802 | A1 | 8/2009 |
| WO | 2009/126540 | A1 | 10/2009 |
| WO | 2012/049845 | A1 | 4/2012 |

* cited by examiner

COLOR CORRECTION APPARATUS, DISPLAY APPARATUS, AND COLOR CORRECTION METHOD

BACKGROUND OF THE INVENTION

Field of the Invention

The present invention relates to a color correction apparatus, a display apparatus, and a color correction method.

Description of the Background Art

An additive process of mixing three primary colors, such as red, green, and blue, to produce various colors is performed in liquid crystal display apparatuses. Thus, tone values indicating three respective primary-color amounts are input to the liquid crystal display apparatus that displays a color according to the three input tone values.

However, in a case where a gradual change in all or some of the three input tone values does not smoothly change a display color, the display color looks unnatural to an observer who is observing it. This problem is significant particularly in the tone of white.

For this reason, γ characteristics that indicate a relationship between a tone value indicating a primary-color amount of input primary color and brightness of primary color components of a display color are corrected to smoothly change the display color when all or some of the three tone values gradually change.

The γ characteristics are often corrected according to a lookup table. The lookup table defines tone conversion characteristics and includes a plurality of input tone values for indexes and a plurality of output tone values respectively corresponding to the plurality of input tone values. When the γ characteristics are corrected according to the lookup table, the tone conversion is performed on pre-tone-conversion tone values according to the lookup table. The tone conversion specifies an output tone value corresponding to an input tone value that coincides with the pre-tone-conversion tone value, and sets a post-tone-conversion tone value to the specified output tone value.

When one lookup table common to all three primary colors is prepared, and the γ characteristics are corrected according to the one prepared lookup table, the tone conversion is performed on each of three pre-tone-conversion tone values according to the one lookup table. In this case, a ratio of the three post-tone-conversion tone values cannot be made different from a ratio of the three pre-tone-conversion tone values, so that the color cannot be corrected.

It has been proposed that three lookup tables corresponding to respective three primary colors are prepared, and the γ characteristics are corrected according to the three prepared lookup tables so as to correct the color. In this case, the ratio of the three post-tone-conversion tone values can be made different from the ratio of the three pre-tone-conversion tone values, so that the color correction can be performed on white. However, the color correction cannot be properly performed on any color depending on characteristics of the liquid crystal display apparatus.

The color correction according to a three-dimensional lookup table has been proposed so as to properly perform the color correction on any color regardless of the characteristics of the liquid crystal display apparatus. The three-dimensional lookup table includes a plurality of groups each of which is a group of input tone values and a plurality of groups each of which is a group of output tone values. The latter groups respectively correspond to the former groups for indexes. For the color correction according to the three-dimensional lookup table, the tone conversion is performed on three tone values according to the three-dimensional lookup table. The tone conversion specifies a group of the output tone values corresponding to a group of the input tone values that coincides with a group of pre-tone-conversion tone values, and sets a group of post-tone-conversion tone values to the specified group of the output tone values. In one example, International Publication No. WO2009/101802 and Japanese Patent Application Laid-Open No. 2002-016939 each disclose the techniques.

In the liquid crystal display apparatus, a frame image needs to be displayed immediately after an input of a signal that expresses the frame image. Thus, the processing on the signal that includes the color correction needs to be performed in real time. Therefore, the three-dimensional lookup table is preferably installed in hardware for the color correction according to the three-dimensional lookup table.

For the conventional color correction according to the three-dimensional lookup table, however, the three-dimensional lookup table needs to hold $256^3 \times 3 = 50{,}331{,}648$ bits of correction data to cover all combinations of the three tone values that are each expressed by a bit string of 8 bits. This requires many resources to install the three-dimensional lookup table in the hardware. It is thus unrealistic to install the three-dimensional lookup table in the hardware.

A distance between lattice points in the three-dimensional lookup table can be increased to reduce the correction data in order to reduce the necessary resources. When the distance between the lattice points is increased to reduce the correction data, however, the γ characteristics and colors may not be properly corrected between the lattice points.

These problems also arise when the correction is performed in other than the liquid crystal display apparatus.

SUMMARY OF THE INVENTION

It is an object of the present invention to properly correct γ characteristics of each of three primary colors and white and to properly perform color correction on white and any color with small resources.

The present invention is related to a color correction apparatus and a color correction method. The color correction apparatus may be installed in a display apparatus.

A first one-dimensional lookup table, a second one-dimensional lookup table, and a third one-dimensional lookup table define tone conversion characteristics of a first primary color, a second primary color, and a third primary color, respectively.

Tone conversion is performed on a first primary tone value, a second primary tone value, and a third primary tone value according to the first one-dimensional lookup table, the second one-dimensional lookup table, and the third one-dimensional lookup table, respectively. A first secondary tone value, a second secondary tone value, and a third secondary tone value are obtained.

The first primary tone value, the second primary tone value, and the third primary tone value indicate primary-color amounts of the first primary color, the second primary color, and the third primary color, respectively. The first secondary tone value, the second secondary tone value, and the third secondary tone value indicate primary-color amounts of the first primary color, the second primary color, and the third primary color, respectively.

A fourth one-dimensional lookup table, a fifth one-dimensional lookup table, and a sixth one-dimensional lookup table define tone conversion characteristics of white.

Tone conversion is performed on the first primary tone value, the second primary tone value, and the third primary tone value according to the fourth one-dimensional lookup table, the fifth one-dimensional lookup table, and the sixth one-dimensional lookup table, respectively. A fourth secondary tone value, a fifth secondary tone value, and a sixth secondary tone value are obtained.

The fourth secondary tone value, the fifth secondary tone value, and the sixth secondary tone value indicate primary-color amounts of the first primary color, the second primary color, and the third primary color, respectively.

From the first primary tone value, the second primary tone value, and the third primary tone value, the extent of a contribution to a first tertiary tone value of each of the first secondary tone value and the fourth secondary tone value is determined as the extent of a first contribution, the extent of a contribution to a second tertiary tone value of each of the second secondary tone value and the fifth secondary tone value is determined as the extent of a second contribution, and the extent of a contribution to a third tertiary tone value of each of the third secondary tone value and the sixth secondary tone value is determined as the extent of a third contribution.

The first tertiary tone value, the second tertiary tone value, and the third tertiary tone value indicate primary-color amounts of the first primary color, the second primary color, and the third primary color, respectively.

The first tertiary tone value is derived from the first secondary tone value and the fourth secondary tone value such that the extent of the contribution to the first tertiary tone value of each of the first secondary tone value and the fourth secondary tone value takes on the extent of the first contribution. The second tertiary tone value is derived from the second secondary tone value and the fifth secondary tone value such that the extent of the contribution to the second tertiary tone value of each of the second secondary tone value and the fifth secondary tone value takes on the extent of the second contribution. The third tertiary tone value is derived from the third secondary tone value and the sixth secondary tone value such that the extent of the contribution to the third tertiary tone value of each of the third secondary tone value and the sixth secondary tone value takes on the extent of the third contribution.

The three primary colors are each corrected according to the one-dimensional lookup tables, and white is corrected according to the one-dimensional lookup tables. A color expressed by the group of the pre-correction tone values modifies the extent to which the former correction and the latter correction are applied. Thus, the γ characteristics of each of the three primary colors and white are properly corrected, and the color correction is properly performed on white. Moreover, the color correction is properly performed on any color.

The γ characteristics and colors are corrected according to the one-dimensional lookup tables, so that the γ characteristics and the colors are corrected with small resources.

These and other objects, features, aspects and advantages of the present invention will become more apparent from the following detailed description of the present invention when taken in conjunction with the accompanying drawings.

DESCRIPTION OF THE PREFERRED EMBODIMENTS

1 First Preferred Embodiment

1.1 Liquid Crystal Display Apparatus

Figure 1:
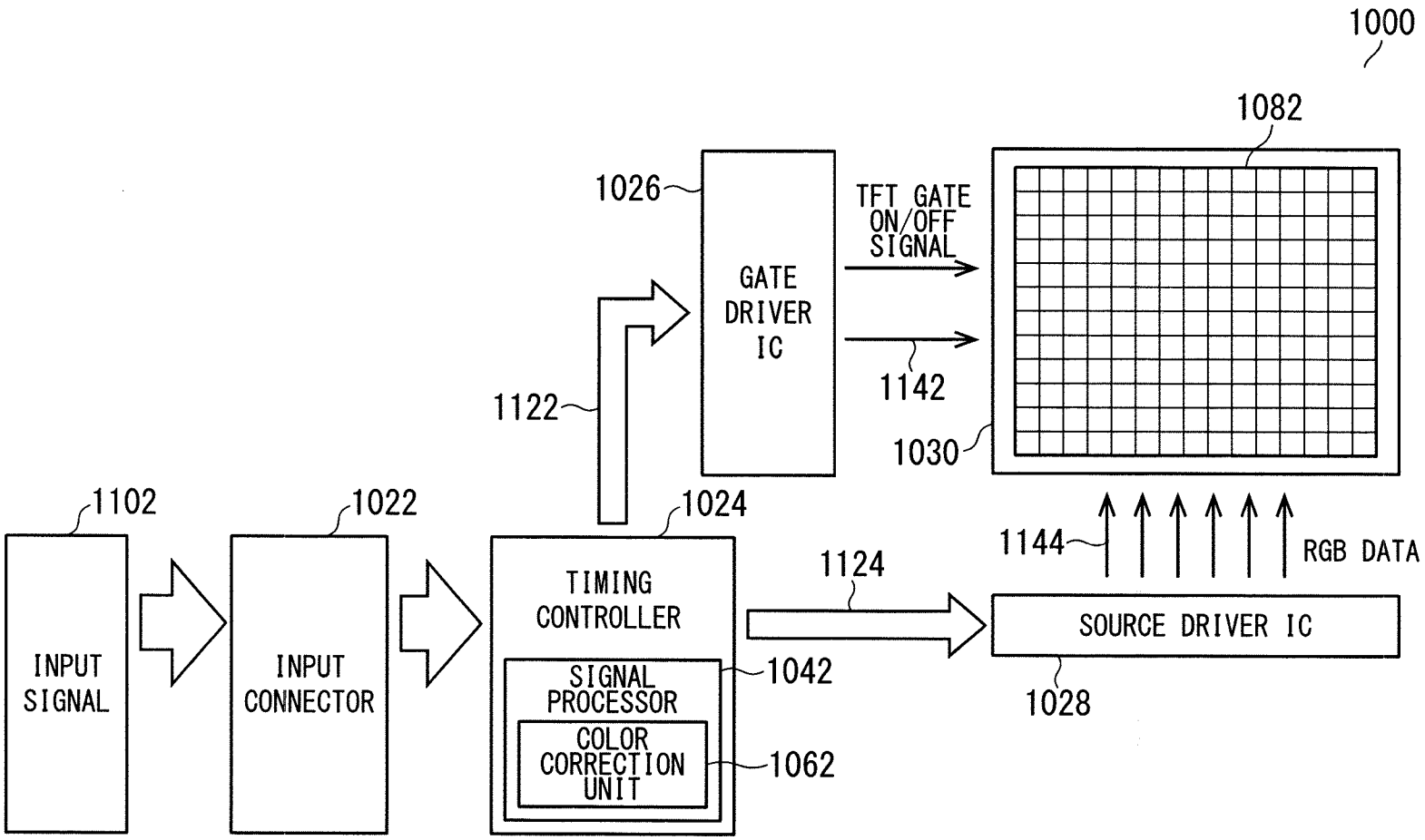
FIG. 1 is a block diagram showing a liquid crystal display apparatus in a first preferred embodiment.

FIG. 1 is a block diagram showing a liquid crystal display apparatus in a first preferred embodiment.

A liquid crystal display apparatus 1000 shown in FIG. 1 includes an input connector 1022, a timing controller 1024, a gate driver integrated circuit (IC) 1026, a source driver IC 1028, and a liquid crystal panel 1030. The timing controller 1024 includes a signal processor 1042. The signal processor 1042 includes a color correction unit 1062. The liquid crystal panel 103 includes a plurality of pixels 1082. The liquid crystal display apparatus 1000 may include components other than the components described above.

An input signal 1102 includes a signal that contains image data. The image data includes tone values Rin, Gin, and Bin for each of the plurality of pixels 1082.

The input signal 1102, which is a digital electrical signal, is input to the input connector 1022 and then input to the timing controller 1024 through the input connector 1022 by line transmission. The input signal 1102 may be replaced with a wirelessly transmitted input signal, and the input connector 1022 may be replaced with a receiver that receives the wirelessly transmitted input signal. The input signal 1102 may be replaced with an input signal, which is an analog electrical signal. The liquid crystal display apparatus 1000 may include an A/D converter that converts the input signal, which is the analog electrical signal, into a digital electrical signal to obtain the tone values Rin, Gin, and Bin.

The signal processor 1042 outputs a signal 1122 used for controlling timing for driving each of the plurality of pixels 1082. The output signal 1122 is input to the gate driver IC 1026. The signal processor 1042 processes the input signal that contains the image data, and outputs a signal 1124 used for controlling a color displayed by each of the plurality of pixels 1082. The output signal 1124 is input to the source driver IC 1028.

The color correction unit 1062 corrects color when the signal 1124 is generated. For the color correction, the pre-correction tone values Rin, Gin, and Bin are input to the color correction unit 1062 and post-correction tone values Rout, Gout, and Bout are output from the color correction unit 1062 for each of the plurality of pixels 1082.

The gate driver IC 1026 outputs an ON/OFF signal 1142 for controlling ON/OFF of a thin-film transistor (TFT) included in each of the plurality of pixels 1082 to a TFT gate based on the signal 1122.

The source driver IC 1028 outputs a color signal 1144 for controlling a color displayed by each of the plurality of pixels 1082 to a TFT source based on the signal 1124. The color signal 1144 reflects the post-correction tone values Rout, Gout, and Bout that compose RGB data.

The gate driver IC 1026 and the source driver IC 1028 form a drive circuit that causes each of the plurality of pixels 1082 to display a color expressed by the group of the post-correction tone values Rout, Gout, and Bout. The drive circuit may be replaced with a drive circuit having a configuration different from the configuration of the drive circuit described above.

The liquid crystal panel 1030 is a display panel. The pixels display the colors expressed by the group of the post-correction tone values Rout, Gout, and Bout for each of the plurality of pixels 1082, to thereby display an image on the liquid crystal panel 1030.

1.2 Tone Conversion

Figure 2:
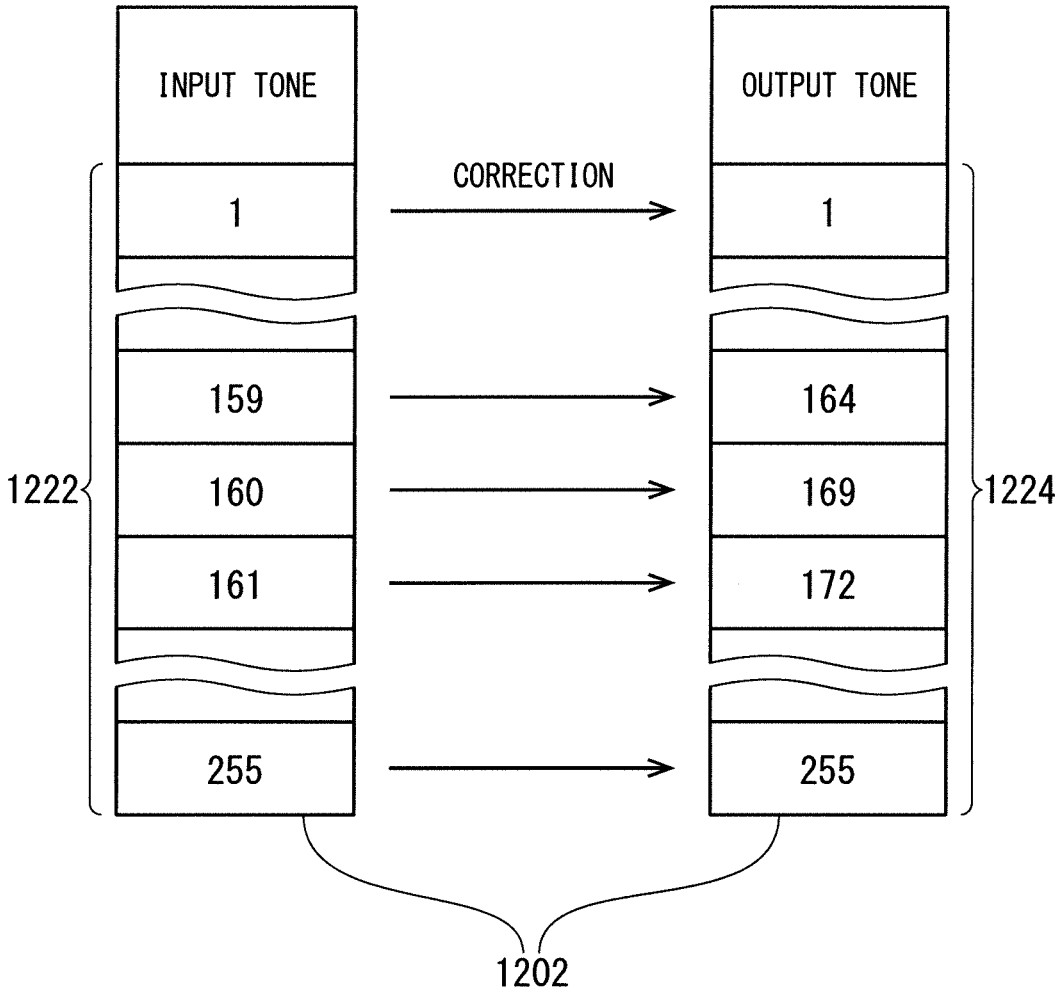
FIG. 2 is a diagram showing an example of tone conversion in the first preferred embodiment.

FIG. 2 is a diagram showing an example of tone conversion in the first preferred embodiment.

A one-dimensional lookup table 1202 shown in FIG. 2 defines tone conversion characteristics in a case where the tone conversion is performed from pre-tone-correction tone values into post-tone-correction tone values. The one-dimensional lookup table 1202 includes 256 input tone values 1222 from 1 . . . 159, 160, 161 to 255 and 256 output tone values 1224 from 1 . . . 164, 169, 172 to 255 respectively corresponding to the 256 input tone values. The input tone values 1222 are each expressed by a bit string of 8 bits. The output tone values 1224 are each expressed by a bit string of 8 bits. The 256 input tone values 1222 may be replaced with a plurality of input tone values each expressed by a bit string of less than or equal to 7 bits or greater than or equal to 9 bits. The 256 output tone values 1224 may be replaced with a plurality of output tone values each expressed by a bit string of less than or equal to 7 bits or greater than or equal to 9 bits.

For the tone conversion according to the one-dimensional lookup table 1202, an input tone value that coincides with a pre-tone-conversion tone value is selected from the 256 input tone values 1222, and a post-tone-conversion tone value is set to an output tone value corresponding to the selected input tone value. Thus, the pre-tone-conversion tone value is converted into the post-tone-conversion tone value. For example, if the pre-tone-conversion tone value is 159, 160, or 161, the post-tone-conversion tone value is 164, 169, or 172, respectively.

1.3 Color Correction Apparatus

Figure 3:
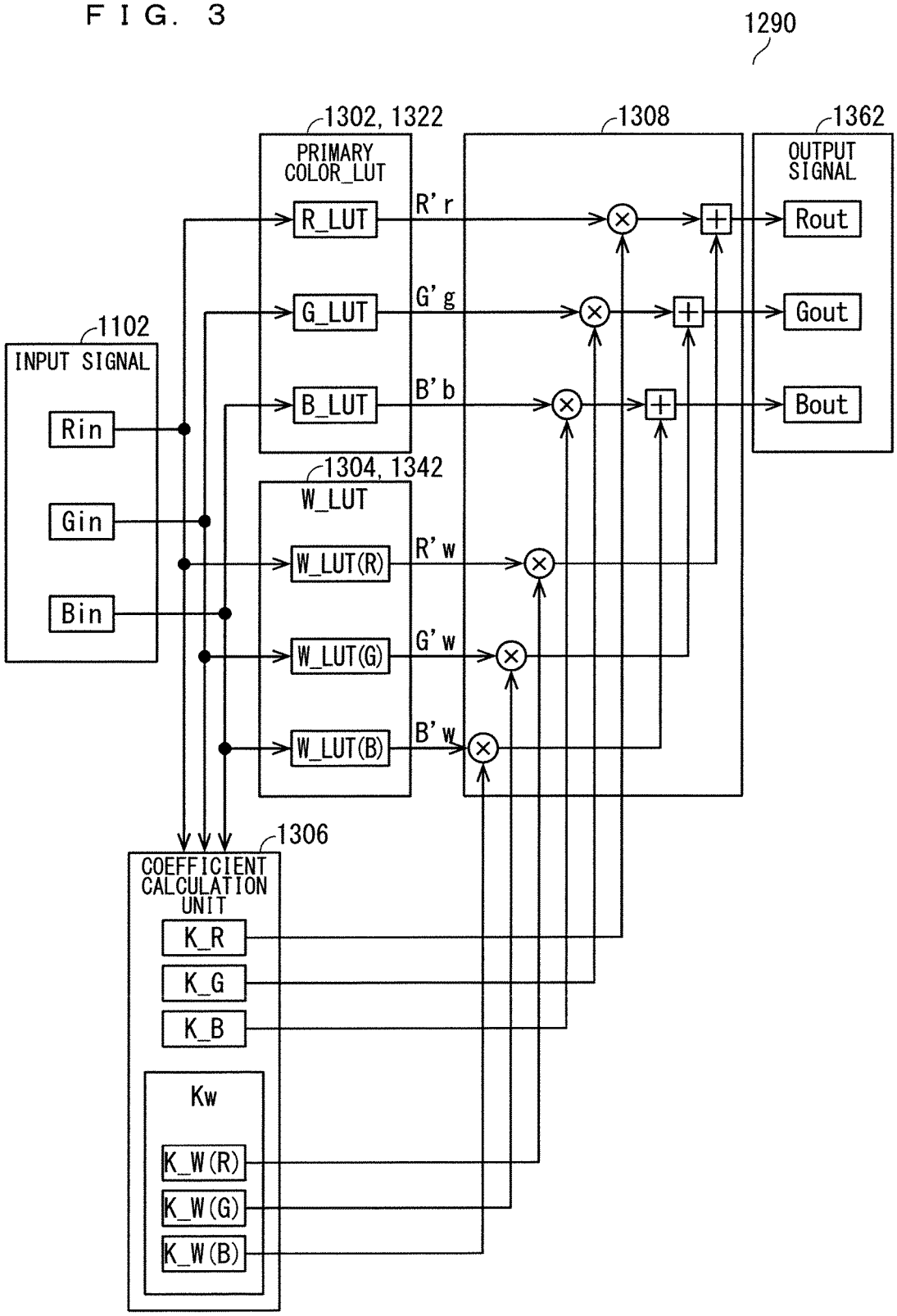
FIG. 3 is a block diagram showing a color correction apparatus in the first preferred embodiment.

FIG. 3 is a block diagram showing a color correction apparatus in the first preferred embodiment.

A color correction apparatus 1290 shown in FIG. 3 is installed as the color correction unit 1062 in the liquid crystal display apparatus 1000, and includes a primary-color correction unit 1302, a white correction unit 1304, a coefficient calculation unit 1306, and a tone-value calculation unit 1308. The primary-color correction unit 1302 includes a primary-color tone conversion unit 1322. The white correction unit 1304 includes a white tone conversion unit 1342. The color correction apparatus 1290 may include components other than the components described above.

The color correction apparatus 1290 may be installed in a liquid crystal display apparatus having a configuration different from the configuration of the liquid crystal display apparatus 1000, in a display apparatus other than the liquid crystal display apparatus, or in an apparatus other than the display apparatus.

The input signal 1102 includes a primary tone value Rin, a primary tone value Gin, and a primary tone value Bin that respectively indicate primary-color amounts of red (R), green (G), and blue (B), which are three primary colors. The primary tone values Rin, Gin, and Bin, which are pre-correction tone values, are input to each of the primary-color correction unit 1302, the white correction unit 1304, and the coefficient calculation unit 1306. R, G, and B may be replaced with three primary colors other than R, G, and B.

The primary-color tone conversion unit 1322 holds primary-color one-dimensional lookup tables R_LUT, G_LUT, and B_LUT that are a set of the one-dimensional lookup tables for correcting the primary tone values Rin, Gin, and Bin and define the tone conversion characteristics of R, G, and B, respectively. The primary-color one-dimensional lookup tables R_LUT, G_LUT, and B_LUT are used for correcting the γ characteristics of R, G, and B, respectively, and are preferably mounted on the hardware.

The primary-color tone conversion unit 1322 performs the tone conversion on the primary tone value Rin according to the one-dimensional lookup table R_LUT to obtain a post-tone-conversion tone value R'r. The primary-color tone conversion unit 1322 performs the tone conversion on the primary tone value Gin according to the one-dimensional lookup table G_LUT to obtain a post-tone-conversion tone value G'g. The primary-color tone conversion unit 1322 performs the tone conversion on the primary tone value Bin according to the one-dimensional lookup table B_LUT to obtain a post-tone-conversion tone value B'b. The post-tone-conversion tone values R'r, G'g, and B'b output from the primary-color tone conversion unit 1322 are secondary tone values R'r, G'g, and B'b output from the primary-color correction unit 1302 without being processed. Thus, the primary-color correction unit 1302 obtains the secondary tone values R'r, G'g, and B'b. The secondary tone values R'r, G'g, and B'b indicate primary-color amounts of R, G, and B, respectively.

The white tone conversion unit 1342 holds one-dimensional lookup tables W_LUT (R), W_LUT (G), and W_LUT (B) that are a set of the one-dimensional lookup tables for correcting the primary tone values Rin, Gin, and Bin and define the tone conversion characteristics of white (W). Since W is a mixed color of R, G, and B, the tone conversion characteristics of W are defined by the group of the one-dimensional lookup tables W_LUT (R), W_LUT (G), and W_LUT (B) that respectively define the tone conversion characteristics of R, G, and B. The one-dimensional lookup tables W_LUT (R), W_LUT (G), and W_LUT (B) are used for correcting the γ characteristics and the color of W, and are preferably mounted on the hardware.

The white tone conversion unit 1342 performs the tone conversion on the primary tone value Rin according to the one-dimensional lookup table W_LUT (R) to obtain a post-tone-conversion tone value R'w. The white tone conversion unit 1342 performs the tone conversion on the primary tone value Gin according to the one-dimensional lookup table W_LUT (G) to obtain a post-tone-conversion tone value G'w. The white tone conversion unit 1342 performs the tone conversion on the primary tone value Bin according to the one-dimensional lookup table W_LUT (B) to obtain a post-tone-conversion tone value B'w. The post-tone-conversion tone values R'w, G'w, and B'w output from the white tone conversion unit 1342 are secondary tone values R'w, G'w, and B'w output from the white correction unit 1304 without being processed. Thus, the white correction unit 1304 obtains the secondary tone values R'w, G'w, and B'w. The secondary tone values R'w, G'w, and B'w indicate primary-color amounts of R, G, and B, respectively.

The coefficient calculation unit 1306 calculates weighting coefficients K_R, K_G, K_B, K_W (R), K_W (G), and K_W (B) from the primary tone values Rin, Gin, and Bin. The weighting coefficients K_R, K_G, K_B, K_W (R), K_W (G), and K_W (B) correspond to the one-dimensional lookup tables R_LUT, G_LUT, B_LUT, W_LUT (R), W_LUT (G), and W_LUT (B), respectively. The weighting coefficients K_R, K_G, K_B, K_W (R), K_W (G), and K_W (B) indicate weightings of the post-tone-conversion tone values obtained from the tone conversion performed according to the corresponding one-dimensional lookup tables. Therefore, the weighting coefficients K_R, K_G, K_B, K_W (R), K_W (G), and K_W (B) indicate weightings of the secondary tone values R'r, G'g, B'b, R'w, G'w, and B'w, respectively.

The tone-value calculation unit 1308 determines, as a tertiary tone value Rout, a weighted sum K_R×R'r+K_W (R)×R'w that the weighting coefficients K_R and K_W (R) are respectively multiplied by the secondary tone values R'r and R'w. The tone-value calculation unit 1308 determines, as a tertiary tone value Gout, a weighted sum K_G×G'g+K_W (G)×G'w that the weighting coefficients K_G and K_W (G) are respectively multiplied by the secondary tone values G'g and G'w. The tone-value calculation unit 1308 determines, as a tertiary tone value Bout, a weighted sum K_B B'b+K_W (B)×B'w that the weighting coefficients K_B and K_W (B) are respectively multiplied by the secondary tone values B'b and B'w. The tertiary tone values Rout, Gout, and Bout contained in an output signal 1362 are post-correction tone values and indicate primary-color amounts of R, G, and B, respectively.

The smaller weighting coefficient K_R reduces the contribution to the tertiary tone value Rout of the secondary tone value R'r while the greater weighting coefficient K_R increases the contribution to the tertiary tone value Rout of the secondary tone value R'r. The smaller weighting coefficient K_W (R) reduces the contribution to the tertiary tone value Rout of the secondary tone value R'w while the greater weighting coefficient K_W (R) increases the contribution to the tertiary tone value Rout of the secondary tone value R'w. Thus, the weighting coefficients K_R and K_W (R) express the extent of the contribution to the tertiary tone value Rout of the secondary tone value R'r and to the tertiary tone value Rout of the secondary tone value R'w, respectively.

Similarly, the weighting coefficients K_G and K_W (G) express the extent of the contribution to the tertiary tone value Gout of the secondary tone value G'g and to the tertiary tone value Gout of the secondary tone value G'w, respectively, and the weighting coefficients K_B and K_W (B) express the extent of the contribution to the tertiary tone value Bout of the secondary tone value B'b and to the tertiary tone value Bout of the secondary tone value B'w, respectively.

Therefore, the coefficient calculation unit 1306 includes a determination unit that determines the extent of the contribution to the tertiary tone value Rout of each of the secondary tone values R'r and R'w as an extent expressed by the weighting coefficients K_R and K_W (R), that determines the extent of the contribution to the tertiary tone value Gout of each of the secondary tone values G'g and G'w as an extent expressed by the weighting coefficients K_G and K_W (G), and that determines the extent of the contribution to the tertiary tone value Bout of each of the secondary tone values B'b and B'w as an extent expressed by the weighting coefficients K_B and K_W (B).

The tone-value calculation unit 1308 includes a derivation unit that derives the tertiary tone value Rout from the secondary tone values R'r and R'w such that the extent of the contribution to the tertiary tone value Rout of each of the secondary tone values R'r and R'w takes on an extent expressed by the weighting coefficients K_R and K_W (R), that derives the tertiary tone value Gout from the secondary tone values G'g and G'w such that the extent of the contribution to the tertiary tone value Gout of each of the secondary tone values G'g and G'w takes on an extent expressed by the weighting coefficients K_G and K_W (G), and that derives the tertiary tone value Bout from the secondary tone values B'b and B'w such that the extent of the contribution to the tertiary tone value Bout of each of the secondary tone values B'b and B'w takes on an extent expressed by the weighting coefficients K_B and K_W (B).

For the calculation of the weighting coefficients K_R, K_G, K_B, K_W (R), K_W (G), and K_W (B), an indicator Kw that indicates the similarity of a color expressed by the group of the primary tone values Rin, Gin, and Bin to W is calculated by an expression (1).

$$Kw=1-(\mathrm{RGBin_MAX}-\mathrm{RGBin_MIN})/\mathrm{RGBin_MAX} \quad (1)$$

The maximum value RGBin_MAX is a maximum value of the primary tone values Rin, Gin, and Bin and is calculated by an expression (2).

$$\mathrm{RGBin_MAX}=\mathrm{MAX}(\mathrm{Rin},\mathrm{Gin},\mathrm{Bin}) \quad (2)$$

The minimum value RGBin_MIN is a minimum value of the primary tone values Rin, Gin, and Bin and is calculated by an expression (3).

$$\mathrm{RGBin_MIN}=\mathrm{MIN}(\mathrm{Rin},\mathrm{Gin},\mathrm{Bin}) \quad (3)$$

The indicator Kw is one when the color expressed by the group of the primary tone values Rin, Gin, and Bin is W since Rin=Gin=Bin, and the indicator Kw is zero when the above-mentioned color is R, G, or B since two of the primary tone values Rin, Gin, and Bin are zero. The indicator Kw increases as the above-mentioned color is closer to white. Thus, the indicator Kw is a factor that indicates the weighting of W, and an indicator 1−Kw that 1 is subtracted from the indicator Kw is a factor indicating a total of the weightings of R, G, and B.

An indicator Kr that indicates the similarity of the color expressed by the group of the primary tone values Rin, Gin, and Bin to R is calculated by an expression (4). An indicator Kg that indicates the similarity of the above-mentioned color to G is calculated by an expression (5). An indicator Kb that indicates the similarity of the above-mentioned color to B is calculated by an expression (6).

$$Kr=(1-Kw)\times\mathrm{Rin}/(\mathrm{Rin}+\mathrm{Gin}+\mathrm{Bin}) \quad (4)$$

$$Kg=(1-Kw)\times\mathrm{Gin}/(\mathrm{Rin}+\mathrm{Gin}+\mathrm{Bin}) \quad (5)$$

$$Kb=(1-Kw)\times\mathrm{Bin}/(\mathrm{Rin}+\mathrm{Gin}+\mathrm{Bin}) \quad (6)$$

The indicator 1−Kw is a factor that indicates the total of the weightings of R, G, and B. A ratio among Rin/(Rin+Gin+Bin), Gin/(Rin+Gin+Bin), and Bin/(Rin+Gin+Bin) indicates a ratio among the weightings of R, G, and B. Therefore, the total of the weightings of R, G, and B are distributed to each of the primary colors of R, G, and B depending on the weighting of each of the primary colors according to the expressions (4), (5), and (6).

Further, the weighting coefficients K_W (R), K_W (G), K_W (B), K_R, K_G, and K_B are calculated by expressions (7), (8), (9), (10), (11), and (12), respectively.

$$K_W(R)=Kw/(Kr+Kw) \quad (7)$$

$$K_W(G)=Kw/(Kg+Kw) \quad (8)$$

$$K_W(B)=Kw/(Kb+Kw) \quad (9)$$

$$K_R=1-K_W(R) \quad (10)$$

$$K_G=1-K_W(G) \quad (11)$$

$$K_B=1-K_W(B) \quad (12)$$

The indicator Kr is a factor that indicates the weighting of R, and the indicator Kw is a factor that indicates the weighting of W. Thus, the weighting coefficient K_W (R), which is the ratio of the indicator Kw to the sum of the indicators Kr and Kw, specifies a ratio for the correction that needs to be applied to W, which is affected the most by the characteristics of the liquid crystal display apparatus 1000. Similarly, the weighting coefficients K_W (G) and K_W (B) each specify a ratio for the correction that needs to be applied to W, which is affected the most by the characteristics of the liquid crystal display apparatus 1000.

The expressions (1) to (12) serve as an example, and the weighting coefficients K_W (R), K_W (G), K_W (B), K_R, K_G, and K_B may be calculated by an expression other than the expressions (1) to (12).

The weighting coefficients K_W (R), K_W (G), K_W (B), K_R, K_G, and K_B each take on a value of greater than or equal to 0 and less than or equal to 1. The sum of the weighting coefficients K_R and K_W (R) is 1. The sum of the weighting coefficients K_G and K_W (G) is 1. The sum of the weighting coefficients K_B and K_W (B) is 1. Thus, the tertiary tone values Rout, Gout, and Bout are obtained from the simple weighted sums.

According to the weighting coefficients K_W (R), K_W (G), K_W (B), K_R, K_G, and K_B, as the color expressed by the group of the primary tone values Rin, Gin, and Bin is closer to white and the indicator Kw increases, the contribution to the tertiary tone value Rout of the secondary tone value R'r decreases, the contribution to the tertiary tone value Rout of the secondary tone value R'w increases, the contribution to the tertiary tone value Gout of the secondary tone value G'g decreases, the contribution to the tertiary tone value Gout of the secondary tone value G'w increases, the contribution to the tertiary tone value Bout of the secondary tone value B'b decreases, and the contribution to the tertiary tone value Bout of the secondary tone value B'w increases.

The coefficient indicating the extent of the contribution to the tertiary tone value Rout of each of the secondary tone values R'r and R'w, the coefficient indicating the extent of the contribution to the tertiary tone value Gout of each of the secondary tone values G'g and G'w, the coefficient indicating the extent of the contribution to the tertiary tone value Bout of each of the secondary tone values B'b and B'w would be replaced with coefficients according to another calculation expression if the expression for deriving the tertiary tone values Rout, Gout, and Bout is replaced.

In the first preferred embodiment, the γ characteristics of R, G, and B are corrected according to the one-dimensional lookup tables R_LUT, G_LUT, and B_LUT, respectively, and the γ characteristics and the color of W are corrected according to the one-dimensional lookup tables W_LUT (R), W_LUT (G), and W_LUT (B). The extent of the contribution to the post-correction tone values Rout, Gout, and Bout of each of the tone values R'r, G'g, and B'b obtained from the former correction and the tone values R'w, G'w, and B'w obtained from the latter correction is modified according to a color expressed by the group of the pre-correction tone values Rin, Gin, and Bin. Thus, the γ characteristics of each of R, G, B, and W are properly corrected, and the color correction is properly performed on W. Moreover, the color correction is properly performed on any color. Therefore, the color correction is performed on any color according to the characteristics of the liquid crystal panel 1030 in the liquid crystal display apparatus 1000 in which the color correction apparatus 1290 is installed.

In the first preferred embodiment, the γ characteristics and colors are corrected according to the one-dimensional lookup tables R_LUT, G_LUT, B_LUT, W_LUT (R), W_LUT (G), and W_LUT (B), so that the γ characteristics and the colors can be corrected with small resources.

2 Second Preferred Embodiment

A second preferred embodiment is related to a color correction apparatus that replaces the color correction apparatus in the first preferred embodiment.

While each primary color is corrected according to the one-dimensional lookup table in the color correction apparatus in the first preferred embodiment, each primary color is corrected according to three one-dimensional lookup tables in the color correction apparatus in the second preferred embodiment. The purpose is to improve accuracy of the color correction performed on each primary color.

Figure 4:
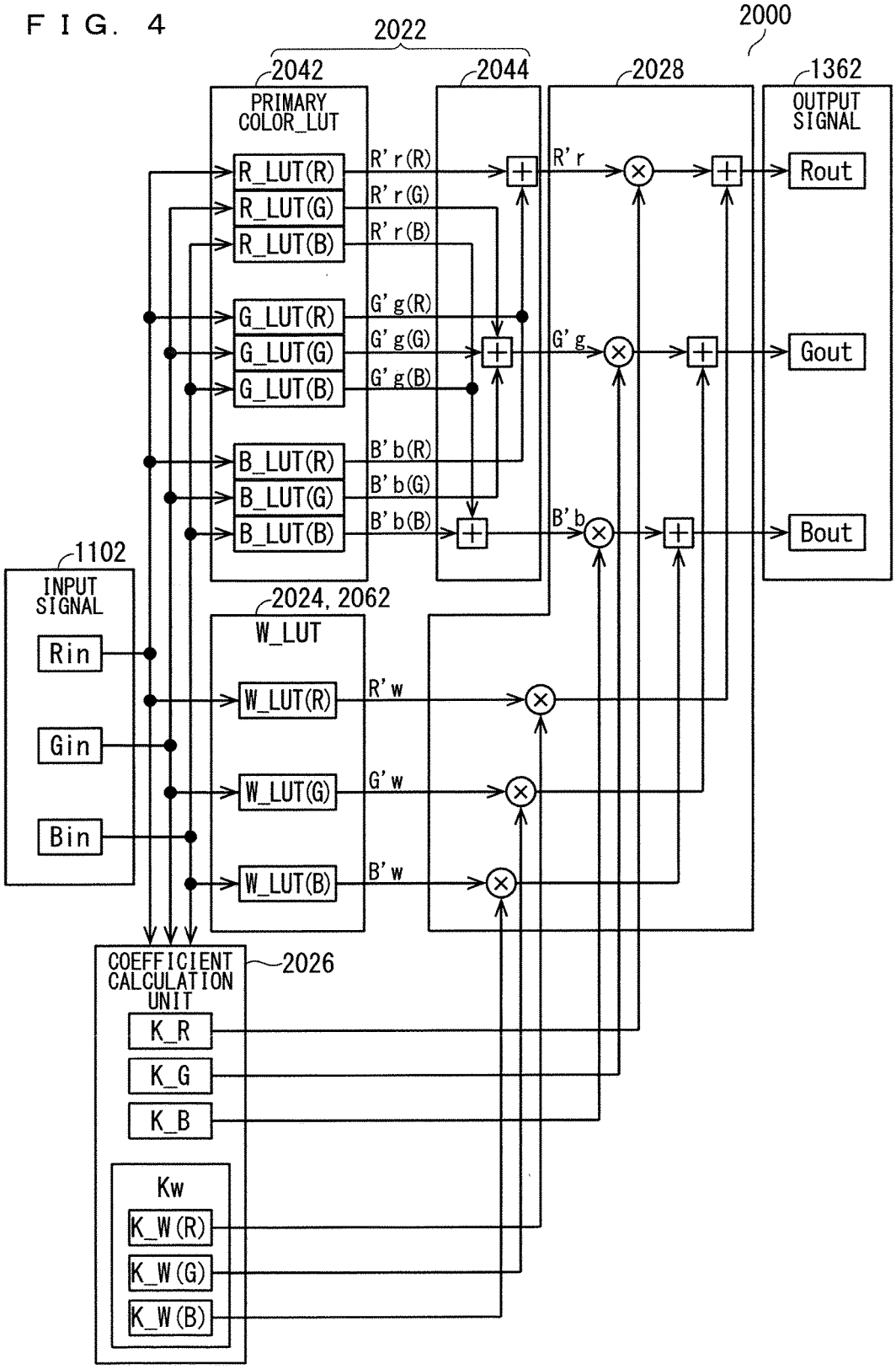
FIG. 4 is a block diagram showing a color correction apparatus in a second preferred embodiment.

FIG. 4 is a block diagram showing the color correction apparatus in the second preferred embodiment.

A color correction apparatus 2000 shown in FIG. 4 includes a primary-color correction unit 2022, a white correction unit 2024, a coefficient calculation unit 2026, and a tone-value calculation unit 2028. The primary-color correction unit 2022 includes a primary-color tone conversion unit 2042 and an arithmetic unit 2044. The white correction unit 2024 includes a white tone conversion unit 2062. The white correction unit 2024, the coefficient calculation unit 2026, the tone-value calculation unit 2028, and the white tone conversion unit 2062 included in the color correction apparatus 2000 in the second preferred embodiment are respectively the same as the white correction unit 1304, the coefficient calculation unit 1306, the tone-value calculation unit 1308, and the white tone conversion unit 1342 included in the color correction apparatus 1290 in the first preferred embodiment. Thus, the primary-color correction unit 2022, the primary-color tone conversion unit 2042, and the arithmetic unit 2044 will be mainly described below.

The primary-color tone conversion unit 2042 holds one-dimensional lookup tables R_LUT (R), R_LUT (G), and R_LUT (B) that each define tone conversion characteristics of R, one-dimensional lookup tables G_LUT (R), G_LUT (G), and G_LUT (B) that each define tone conversion characteristics of G, and one-dimensional lookup tables B_LUT (R), B_LUT (G), and B_LUT (B) that each define tone conversion characteristics of B. The primary-color one-dimensional lookup tables R_LUT (R), R_LUT (G), and R_LUT (B) are used for correcting outputs of R, G, and B for the primary tone value Rin, and are preferably mounted on the hardware. The primary-color one-dimensional lookup tables G_LUT (R), G_LUT (G), and G_LUT (B) are used for correcting outputs of R, G, and B for the primary tone value Gin, and are preferably mounted on the hardware. The primary-color one-dimensional lookup tables B_LUT (R), B_LUT (G), and B_LUT (B) are used for correcting outputs of R, G, and B for the primary tone value Bin, and are preferably mounted on the hardware.

The primary-color tone conversion unit 2042 performs the tone conversion on the primary tone value Rin according to the one-dimensional lookup tables R_LUT (R), R_LUT (G), and R_LUT (B) to obtain post-tone-conversion tone values R'r (R), R'r (G), and R'r (B) respectively. The primary-color tone conversion unit 2042 performs the tone conversion on the primary tone value Gin according to the primary-color one-dimensional lookup tables G_LUT (R), G_LUT (G), and G_LUT (B) to obtain post-tone-conversion tone values G'g (R), G'g (G), and G'g (B) respectively. The primary-color tone conversion unit 2042 performs the tone conversion on the primary tone value Bin according to the primary-color one-dimensional lookup tables B_LUT (R), B_LUT (G), and B_LUT (B) to obtain post-tone-conversion tone values B'b (R), B'b (G), and B'b (B) respectively. The post-tone-conversion tone values R'r (R), G'g (R), and B'b (R) each indicate a primary-color amount of R. The post-tone-conversion tone values R'r (G), G'g (G), and B'b (G) each indicate a primary-color amount of G. The post-tone-conversion tone values R'r (B), G'g (B), and B'b (B) each indicate a primary-color amount of B.

The arithmetic unit 2044 adds the post-tone-conversion tone values R'r (R), G'g (R), and B'b (R) to obtain a secondary tone value R'r=R'r (R)+G'g (R)+B'b (R). The arithmetic unit 2044 adds the post-tone-conversion tone values R'r (G), G'g (G), and B'b (G) to obtain a secondary tone value G'g=R'r (G)+G'g (G)+B'b (G). The arithmetic unit 2044 adds the post-tone-conversion tone values R'r (B), G'g (B), and B'b (B) to obtain a secondary tone value B'b=R'r (B)+G'g (B)+B'b (B). The post-tone-conversion tone values R'r, G'g, and B'b are output from the primary-color correction unit 2022.

The γ characteristics of each of R, G, B, and W are properly corrected, and the color correction is properly performed on W and any color in the second preferred embodiment similarly to the first preferred embodiment. If the color correction apparatus 2000 instead of the color correction apparatus 1290 is installed in the liquid crystal display apparatus 1000, the color correction is performed on any color according to the characteristics of the liquid crystal panel 1030.

The γ characteristics and colors can be corrected with small resources in the second preferred embodiment similarly to the first preferred embodiment.

Moreover, the accuracy of the color correction performed on each primary color is improved in the second preferred embodiment.

3 Third Preferred Embodiment

A third preferred embodiment is related to a color correction apparatus that replaces the color correction apparatus in the first preferred embodiment.

While the weighting coefficients K_R, KG, K_B, K_W (R), K_W (G), and K_W (B) corresponding to the one-dimensional lookup tables R_LUT, G_LUT, B_LUT, W_LUT (R), W_LUT (G), and W_LUT (B), respectively, are calculated to perform the correction according to the six one-dimensional lookup tables in the color correction apparatus in the first preferred embodiment, one common weighting coefficient K_RGB corresponding to one-dimensional lookup tables R_LUT, G_LUT, and B_LUT is calculated and a common weighting coefficient K_W corresponding to one-dimensional lookup tables W_LUT (R), W_LUT (G), and W_LUT (B) is calculated to perform the correction according to the six one-dimensional lookup tables in the color correction apparatus in the third preferred embodiment. The purpose is to reduce computational complexity required for calculating the weighting coefficients.

Figure 5:
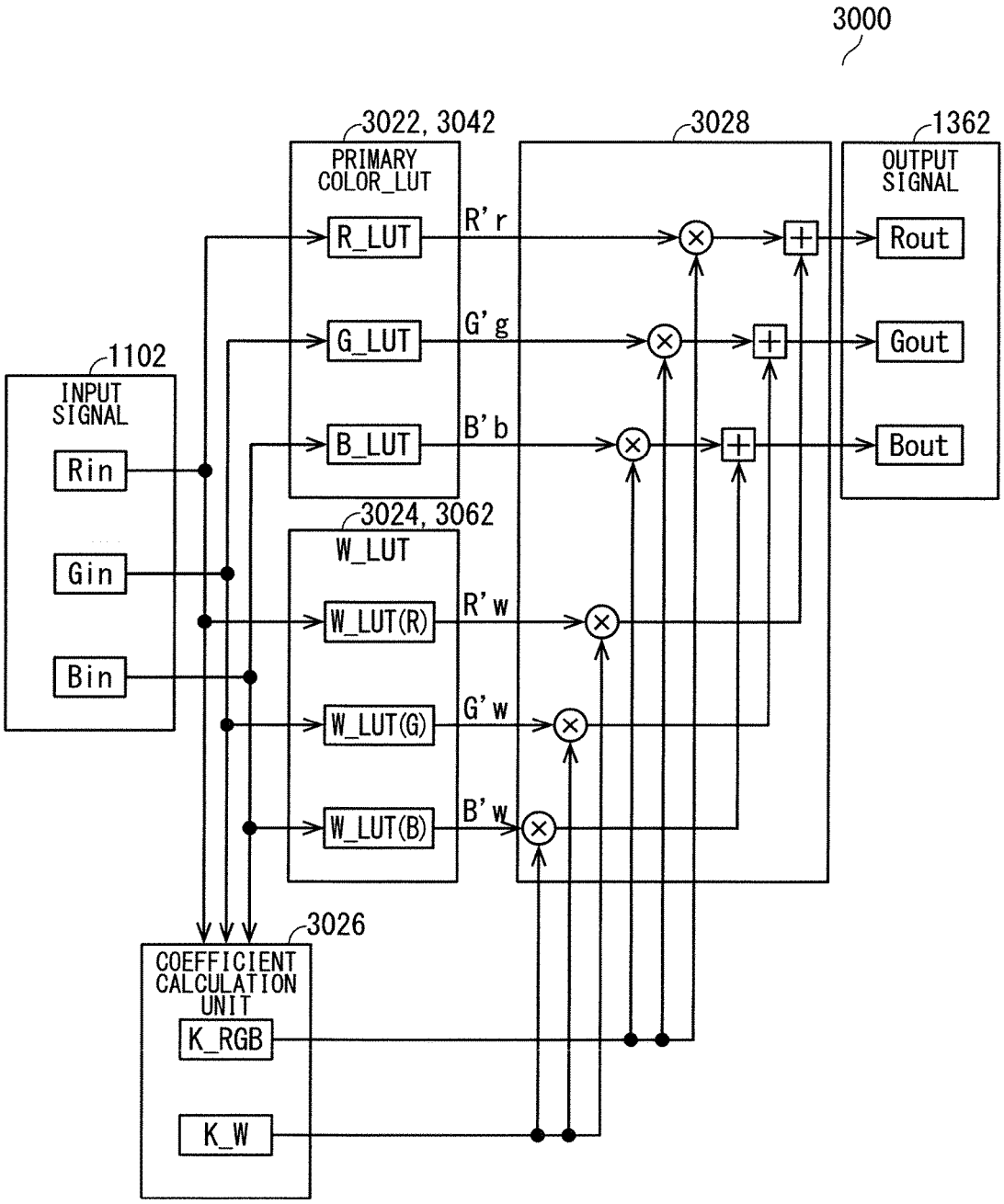
FIG. 5 is a block diagram showing a color correction apparatus in a third preferred embodiment.

FIG. 5 is a block diagram showing the color correction apparatus in the third preferred embodiment.

A color correction apparatus 3000 shown in FIG. 5 is installed as a color correction unit 1062 in the liquid crystal display apparatus 1000, and includes a primary-color correction unit 3022, a white correction unit 3024, a coefficient calculation unit 3026, and a tone-value calculation unit 3028. The primary-color correction unit 3022 includes a primary-color tone conversion unit 3042. The white correction unit 3024 includes a white tone conversion unit 3062. The color correction apparatus 3000 may include components other than the components described above. The primary-color correction unit 3022, the white correction unit 3024, the primary-color tone conversion unit 3042, and the white tone conversion unit 3062 included in the color correction apparatus 3000 in the third preferred embodiment are respectively the same as the primary-color tone conversion unit 1302, the white correction unit 1304, the primary-color tone conversion unit 1322, and the white tone conversion unit 1342 included in the color correction apparatus 1290 in the first preferred embodiment. Thus, the coefficient calculation unit 3026 and the tone-value calculation unit 3028 will be mainly described below.

The color correction apparatus 3000 may be installed in a liquid crystal display apparatus having a configuration different from the configuration of the liquid crystal display apparatus 1000, in a display apparatus other than the liquid crystal display apparatus, or in an apparatus other than the display apparatus.

The coefficient calculation unit 3026 calculates weighting coefficients K_RGB and K_W from primary tone values Rin, Gin, and Bin. The weighting coefficient K_RGB corresponds to the one-dimensional lookup tables R_LUT, G_LUT, and B_LUT. B_LUT. The weighting coefficient K_W corresponds to W_LUT (R), W_LUT (G), and W_LUT (B). The weighting coefficients K_RGB and K_W indicate weightings of post-tone-conversion tone values obtained from the tone conversion performed according to the corresponding one-dimensional lookup tables.

The tone-value calculation unit 3028 determines, as a tertiary tone value Rout, a weighted sum K_RGB×R'r+K_W×R'w that the weighting coefficients K_RGB and K_W are respectively multiplied by secondary tone values R'r and R'w. The tone-value calculation unit 3028 determines, as a tertiary tone value Gout, a weighted sum K_RGB×G'g+K_W×G'w that the weighting coefficients K_RGB and KW are respectively multiplied by secondary tone values G'g and G'w. The tone-value calculation unit 3028 determines, as a tertiary tone value Bout, a weighted sum K_RGB×B'b+K_W×B'w that the weighting coefficients K_RGB and K_W are respectively multiplied by secondary tone values B'b and B'w. The tertiary tone values Rout, Gout, and Bout contained in an output signal 1362 are post-correction tone values and indicate primary-color amounts of R, G, and B, respectively.

The smaller weighting coefficient K_RGB reduces the contribution to the tertiary tone value Rout of the secondary tone value R'r while the greater weighting coefficient K_RGB increases the contribution to the tertiary tone value Rout of the secondary tone value R'r. The smaller weighting coefficient K_W reduces the contribution to the tertiary tone value Rout of the secondary tone value R'w while the greater weighting coefficient K_W increases the contribution to the tertiary tone value Rout of the secondary tone value R'w. Thus, the weighting coefficients K_RGB and K_W express the extent of the contribution to the tertiary tone value Rout of the secondary tone value R'r and to the tertiary tone value Rout of the secondary tone value R'w, respectively.

Similarly, the weighting coefficients K_RGB and K_W express the extent of the contribution to the tertiary tone value Gout of the secondary tone value G'g and to the tertiary tone value Gout of the secondary tone value G'w, respectively, and the weighting coefficients K_RGB and K_W express the extent of the contribution to the tertiary tone value Bout of the secondary tone value B'b and to the tertiary tone value Bout of the secondary tone value B'w, respectively.

Therefore, the coefficient calculation unit 3026 includes a determination unit that determines the extent of the contribution to the tertiary tone value Rout of each of the secondary tone values R'r and R'w as an extent expressed by the weighting coefficients K_RGB and K_W, that determines the extent of the contribution to the tertiary tone value of Gout of each of the secondary tone values G'g and G'w as an extent expressed by the weighting coefficients K_RGB and K_W, and that determines the extent of the contribution to the tertiary tone value Bout of each of the secondary tone values B'b and B'w as an extent expressed by the weighting coefficients K_RGB and K_W.

The tone-value calculation unit 3028 includes a derivation unit that derives the tertiary tone value Rout from the secondary tone values R'r and R'w such that the extent of the contribution to the tertiary tone value Rout of each of the secondary tone values R'r and R'w takes on an extent expressed by the weighting coefficients K_RGB and K_W, that derives the tertiary tone value Gout from the secondary tone values G'g and G'w such that the extent of the contribution to the tertiary tone value Gout of each of the secondary tone values G'g and G'w takes on an extent expressed by the weighting coefficients K_RGB and K_W, and that derives the tertiary tone value Bout from the secondary tone values B'b and B'w such that the extent of the contribution to the tertiary tone value Bout of each of the secondary tone values B'b and B'w takes on an extent expressed by the weighting coefficients K_RGB and K_W.

For the calculation of the weighting coefficients K_RGB and K_W, an indicator K_W that indicates the similarity of a color expressed by the group of the primary tone values Rin, Gin, and Bin to W is calculated by an expression (13).

$$K_W=(\mathrm{RGBin_MED}+\mathrm{RGBin_MIN})/(\mathrm{RGBin_MAX}\times 2) \quad (13)$$

The median value RGBin_MED is a median value of the primary tone values Rin, Gin, and Bin and is calculated by an expression (14).

$$\mathrm{RGBin_MED}=\mathrm{MED}(\mathrm{Rin},\mathrm{Gin},\mathrm{Bin}) \quad (14)$$

The indicator K_W is one when the color expressed by the group of the primary tone values Rin, Gin, and Bin is W since Rin=Gin=Bin, and the indicator KW is zero when the above-mentioned color is R, G, or B since two of the primary tone values Rin, Gin, and Bin are zero. The indicator K_W increases as the above-mentioned color is closer to white. Thus, the indicator K_W is a factor that indicates the weighting of W.

An indicator K_RGB that indicates the similarity of the color expressed by the group of the primary tone values Rin, Gin, and Bin to a monochrome is calculated by an expression (15).

$$K_\mathrm{RGB}=1-K_W \quad (15)$$

The weighting coefficient K_RGB is an indicator that 1 is subtracted from the indicator K_W, and is a factor that indicates a total of the weightings of R, G, and B.

The expressions (13) to (15) serve as an example, and the weighting coefficients K_W and K_RGB may be calculated by an expression other than the expressions (13) to (15). For example, the weighting coefficients K_W and K_RGB may be calculated by expressions (16) and (17).

$$K_W=1-(\mathrm{RGBin_MAX}-\mathrm{RGBin_MIN})/\mathrm{RGBin_MAX} \quad (16)$$

$$K_\mathrm{RGB}=1-K_W \quad (17)$$

The γ characteristics of each of R, G, B, and W are properly corrected, and the color correction is properly performed on W and any color in the third preferred embodiment similarly to the first preferred embodiment.

The γ characteristics and colors can be corrected with smaller resources in the third preferred embodiment than the resources in the first preferred embodiment.

In addition, according to the present invention, the above preferred embodiments can be arbitrarily combined, or each preferred embodiment can be appropriately varied or omitted within the scope of the invention.

In the first to the third preferred embodiments, the preferred embodiments have been described by taking the liquid crystal display apparatus as an example of the display apparatus that includes the color correction apparatus of the present invention. However, the color correction of the present invention does not need to be performed in a specific display apparatus, and may be performed in various display apparatuses such as an organic electroluminescent (EL) display apparatus and a micro electro mechanical system (MEMS) display.

While the invention has been shown and described in detail, the foregoing description is in all aspects illustrative and not restrictive. It is therefore understood that numerous modifications and variations can be devised without departing from the scope of the invention.

What is claimed is:

1. A color correction apparatus that corrects a first primary tone value, a second primary tone value, and a third primary tone value included in an electric signal, comprising:

a first corrector that holds a first one-dimensional lookup table, a second one-dimensional lookup table, and a third one-dimensional lookup table that respectively define tone conversion characteristics of a first primary color, a second primary color, and a third primary color, and performs tone conversion on said first primary tone value indicating a primary-color amount of said first primary color according to said first one-dimensional lookup table, tone conversion on said second primary tone value indicating a primary-color amount of said second primary color according to said second one-dimensional lookup table, and tone conversion on said third primary tone value indicating a primary-color amount of said third primary color according to said third one-dimensional lookup table to obtain a first secondary tone value indicating a primary-color amount of said first primary color, a second secondary tone value indicating a primary-color amount of said second primary color, and a third secondary tone value indicating a primary-color amount of said third primary color;

a second corrector that holds a fourth one-dimensional lookup table, a fifth one-dimensional lookup table, and a sixth one-dimensional lookup table that define tone conversion characteristics of white, and performs tone conversion on said first primary tone value according to said fourth one-dimensional lookup table, tone conversion on said second primary tone value according to said fifth one-dimensional lookup table, and tone conversion on said third primary tone value according to said sixth one-dimensional lookup table to obtain a fourth secondary tone value indicating a primary-color amount of said first primary color, a fifth secondary tone value indicating a primary-color amount of said second primary color, and a sixth secondary tone value indicating a primary-color amount of said third primary color;

a determination assembly that determines, from said first primary tone value, said second primary tone value, and said third primary tone value, extent of a contribution to a first tertiary tone value indicating a primary-color amount of said first primary color of each of said first secondary tone value and said fourth secondary tone value as extent of a first contribution, extent of a contribution to a second tertiary tone value indicating a primary-color amount of said second primary color of each of said second secondary tone value and said fifth secondary tone value as extent of a second contribution, and extent of a contribution to a third tertiary tone value indicating a primary-color amount of said third primary color of each of said third secondary tone value and said sixth secondary tone value as extent of a third contribution;

a derivation assembly that derives said first tertiary tone value from said first secondary tone value and said fourth secondary tone value such that the extent of the contribution to said first tertiary tone value of each of said first secondary tone value and said fourth secondary tone value takes on the extent of said first contribution, derives said second tertiary tone value from said second secondary tone value and said fifth secondary tone value such that the extent of the contribution to said second tertiary tone value of each of said second secondary tone value and said fifth secondary tone value takes on the extent of said second contribution, and derives said third tertiary tone value from said third secondary tone value and said sixth secondary tone value such that the extent of the contribution to said third tertiary tone value of each of said third secondary tone value and said sixth secondary tone value takes on the extent of said third contribution; and a display apparatus that displays, after being corrected, said first primary tone value, said second primary tone value, and said third primary tone value.

2. The color correction apparatus according to claim 1, wherein as a color expressed by a group of said first primary tone value, said second primary tone value, and said third primary tone value is closer to white, said determination assembly reduces the contribution to said first tertiary tone value of said first secondary tone value, increases the contribution to said first tertiary tone value of said fourth secondary tone value, reduces the contribution to said second tertiary tone value of said second secondary tone value, increases the contribution to said second tertiary tone value of said fifth secondary tone value, reduces the contribution to said third tertiary tone value of said third secondary tone value, and increases the contribution to said third tertiary tone value of said sixth secondary tone value.

3. The color correction apparatus according to claim 2, wherein said determination assembly calculates an indicator indicating similarity of the color expressed by the group of said first primary tone value, said second primary tone value, and said third primary tone value to white, and, as the similarity indicated by said indicator gets closer, said determination assembly reduces the contribution to said first tertiary tone value of said first secondary tone value, increases the contribution to said first tertiary tone value of said fourth secondary tone value, reduces the contribution to said second tertiary tone value of said second secondary tone value, increases the contribution to said second tertiary tone value of said fifth secondary tone value, reduces the contribution to said third tertiary tone value of said third secondary tone value, and increases the contribution to said third tertiary tone value of said sixth secondary tone value.

4. The color correction apparatus according to claim 1, wherein the extent of said first contribution is expressed by a first weighting coefficient and a second weighting coefficient that indicate said first secondary tone value and said fourth secondary tone value, respectively, the extent of said second contribution is expressed by a third weighting coefficient and a fourth weighting coefficient that indicate said second secondary tone value and said fifth secondary tone value, respectively, the extent of said third contribution is expressed by a fifth weighting coefficient and a sixth weighting coefficient that indicate said third secondary tone value and said sixth secondary tone value, respectively, said first tertiary tone value is a weighted sum of said first secondary tone value and said fourth secondary tone value in which said first secondary tone value and said fourth secondary tone value are weighted by said first weighting coefficient and said second weighting coefficient respectively, said second tertiary tone value is a weighted sum of said second secondary tone value and said fifth secondary tone value in which said second secondary tone value and said fifth secondary tone value are weighted by said third weighting coefficient and said fourth weighting coefficient respectively, and said third tertiary tone value is a weighted sum of said third secondary tone value and said sixth secondary tone value in which said third secondary tone value and said sixth secondary tone value are weighted by said fifth weighting coefficient and said sixth weighting coefficient, respectively.

5. The color correction apparatus according to claim 1, wherein the extent of said first contribution is expressed by a first weighting coefficient and a second weighting coefficient that indicate said first secondary tone value and said fourth secondary tone value, respectively, the extent of said second contribution is expressed by said first weighting coefficient and said second weighting coefficient that indicate said second secondary tone value and said fifth secondary tone value, respectively, the extent of said third contribution is expressed by said first weighting coefficient and said second weighting coefficient that indicate said third secondary tone value and said sixth secondary tone value, respectively, said first tertiary tone value is a weighted sum of said first secondary tone value and said fourth secondary tone value in which said first secondary tone value and said fourth secondary tone value are weighted by said first weighting coefficient and said second weighting coefficient respectively, said second tertiary tone value is a weighted sum of said second secondary tone value and said fifth secondary tone value in which said second secondary tone value and said fifth secondary tone value are weighted by said first weighting coefficient and said second weighting coefficient respectively, and said third tertiary tone value is a weighted sum of said third secondary tone value and said sixth secondary tone value in which said third secondary tone value and said sixth secondary tone value are weighted by said first weighting coefficient and said second weighting coefficient respectively.

6. The color correction apparatus according to claim 1, wherein said first corrector includes a tone converter that performs tone conversion on said first primary tone value according to said first one-dimensional lookup table to obtain a first post-tone-conversion tone value indicating a primary-color amount of said first primary color, performs tone conversion on said second primary tone value according to said second one-dimensional lookup table to obtain a second post-tone-conversion tone value indicating a primary-color amount of said second primary color, performs tone conversion on said third primary tone value according to said third one-dimensional lookup table to obtain a third post-tone-conversion tone value indicating a primary-color amount of said third primary color, and determines said first post-tone-conversion tone value, said second post-tone-conversion tone value, and said third post-tone-conversion tone value as said first secondary tone value, said second secondary tone value, and said third secondary tone value, respectively.

7. The color correction apparatus according to claim 1, wherein said first corrector includes a tone converter that performs tone conversion on said first primary tone value according to said first one-dimensional lookup table to obtain a first post-tone-conversion tone value indicating a primary-color amount of said first primary color, performs tone conversion on said second primary tone value according to said second one-dimensional lookup table to obtain a second post-tone-conversion tone value indicating a primary-color amount of said second primary color, performs tone conversion on said third primary tone value according to said third one-dimensional lookup table to obtain a third post-tone-conversion tone value indicating a primary-color amount of said third primary color, further holds a seventh one-dimensional lookup table, an eighth one-dimensional lookup table, a ninth one-dimensional lookup table, a tenth one-dimensional lookup table, an eleventh one-dimensional lookup table, and a twelfth one-dimensional lookup table, performs tone conversion on said first primary tone value according to said seventh one-dimensional lookup table and said eighth one-dimensional lookup table to respectively obtain a seventh post-tone-conversion tone value indicating a primary-color amount of said second primary color and an eighth post-tone-conversion tone value indicating a primary-color amount of said third primary color, performs tone conversion on said second primary tone value according to said ninth one-dimensional lookup table and said tenth one-dimensional lookup table to respectively obtain a ninth post-tone-conversion tone value indicating a primary-color amount of said first primary color and a tenth post-tone-conversion tone value indicating a primary-color amount of said third primary color, and performs tone conversion on said third primary tone value according to said eleventh one-dimensional lookup table and said twelfth one-dimensional lookup table to respectively obtain an eleventh post-tone-conversion tone value indicating a primary-color amount of said first primary color and a twelfth post-tone-conversion tone value indicating a primary-color amount of said second primary color, and an arithmetic assembly that adds said first post-tone-conversion tone value, said ninth post-tone-conversion tone value, and said eleventh post-tone-conversion tone value to obtain said first secondary tone value, adds said second post-tone-conversion tone value, said seventh post-tone-conversion tone value, and said twelfth post-tone-conversion tone value to obtain said second secondary tone value, and adds said third post-tone-conversion tone value, said eighth post-tone-conversion tone value, and said tenth post-tone-conversion tone value to obtain said third secondary tone value.

8. The color correction apparatus according to claim 1, wherein said display apparatus comprises:

a display panel for displaying a plurality of pixels; and a drive circuit that causes each of said plurality of pixels to emit light of a color expressed by a group of said first tertiary tone value, said second tertiary tone value, and said third tertiary tone value.

9. A color correction method that corrects a first primary tone value, a second primary tone value, and a third primary tone value included in an electric signal, comprising:

(a) preparing a first one-dimensional lookup table, a second one-dimensional lookup table, and a third one-dimensional lookup table that respectively define tone conversion characteristics of a first primary color, a second primary color, and a third primary color, and performing tone conversion on said first primary tone value indicating a primary-color amount of said first primary color according to said first one-dimensional lookup table, tone conversion on said second primary tone value indicating a primary-color amount of said second primary color according to said second one-dimensional lookup table, and tone conversion on said third primary tone value indicating a primary-color amount of said third primary color according to said third one-dimensional lookup table to obtain a first secondary tone value indicating a primary-color amount of said first primary color, a second secondary tone value indicating a primary-color amount of said second primary color, and a third secondary tone value indicating a primary-color amount of said third primary color;

(b) preparing a fourth one-dimensional lookup table, a fifth one-dimensional lookup table, and a sixth one-dimensional lookup table that define tone conversion characteristics of white, and performing tone conversion on said first primary tone value according to said fourth one-dimensional lookup table, tone conversion on said second primary tone value according to said fifth one-dimensional lookup table, tone conversion on said third primary tone value according to said sixth one-dimensional lookup table to obtain a fourth secondary tone value indicating a primary-color amount of said first primary color, a fifth secondary tone value indicating a primary-color amount of said second primary color, and a sixth secondary tone value indicating a primary-color amount of said third primary color;

(c) determining, from said first primary tone value, said second primary tone value, and said third primary tone value, extent of a contribution to a first tertiary tone value indicating a primary-color amount of said first primary color of each of said first secondary tone value and said fourth secondary tone value as extent of a first contribution, extent of a contribution to a second tertiary tone value indicating a primary-color amount of said second primary color of each of said second secondary tone value and said fifth secondary tone value as extent of a second contribution, and extent of a contribution to a third tertiary tone value indicating a primary-color amount of said third primary color of each of said third secondary tone value and said sixth secondary tone value as extent of a third contribution;

(d) deriving said first tertiary tone value from said first secondary tone value and said fourth secondary tone value such that the extent of the contribution to said first tertiary tone value of each of said first secondary tone value and said fourth secondary tone value takes on the extent of said first contribution, deriving said second tertiary tone value from said second secondary tone value and said fifth secondary tone value such that the extent of the contribution to said second tertiary tone value of each of said secondary tone value and said fifth secondary tone value takes on the extent of said second contribution, and deriving said third tertiary tone value from said third secondary tone value and said sixth secondary tone value such that the extent of the contribution to said third tertiary tone value of each of said third secondary tone value and said sixth secondary tone value takes on the extent of said third contribution; and (e) displaying on a display apparatus, after being corrected, said first primary tone value, said second primary tone value, and said third primary tone value.

* * * * *